US007323845B2

(12) United States Patent
Hong et al.

(10) Patent No.: US 7,323,845 B2
(45) Date of Patent: Jan. 29, 2008

(54) APPARATUS FOR CONTROLLING OPERATION OF COMPRESSOR AND METHOD THEREFORE

(75) Inventors: Eon-Pyo Hong, Seoul (KR); Kyeong-Bae Park, Seoul (KR); Tae-Hee Kwak, Incheon (KR); Ki-Chul Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 445 days.

(21) Appl. No.: 11/011,430

(22) Filed: Dec. 15, 2004

(65) Prior Publication Data

US 2005/0271519 A1 Dec. 8, 2005

(30) Foreign Application Priority Data

Jun. 3, 2004 (KR) ..... 10-2004-0040449

(51) Int. Cl.
*H02P 5/40* (2006.01)

(52) U.S. Cl. ..... 318/806; 318/807; 417/44.1; 417/44.11

(58) Field of Classification Search ..... 318/126, 318/245, 721, 794, 785, 806, 807; 417/44.1
See application file for complete search history.

(56) References Cited

U.S. PATENT DOCUMENTS 5,239,252 A * 8/1993 Runggaldier et al. ..... 318/806
5,359,273 A * 10/1994 Fluckiger ..... 318/794
5,973,473 A * 10/1999 Anderson et al. ..... 318/785
5,986,417 A * 11/1999 Nicolai et al. ..... 318/245
6,201,369 B1 * 3/2001 Johnson ..... 318/811
6,623,246 B2 * 9/2003 Hwang et al. ..... 417/44.1
6,682,310 B2 * 1/2004 Yoo et al. ..... 417/42
7,071,650 B2 * 7/2006 Ilda ..... 318/785
2002/0150477 A1 * 10/2002 Hwang et al. ..... 417/44.1
2003/0128008 A1 * 7/2003 Marioni ..... 318/721
2005/0110435 A1 * 5/2005 Ballenger et al. ..... 315/307
2005/0231151 A1 * 10/2005 Ilda ..... 318/785
2006/0108969 A1 * 5/2006 Han et al. ..... 318/807
2006/0127225 A1 * 6/2006 Kim et al. ..... 417/44.1
2006/0228224 A1 * 10/2006 Hong et al. ..... 417/44.1

FOREIGN PATENT DOCUMENTS

CN 1269626 A 10/2000
CN 1430702 A 7/2003
GB 1294332 A 10/1972
JP 05122974 A * 5/1993
KR 1020030069711 A 8/2003

* cited by examiner

*Primary Examiner*—Paul Ip
(74) *Attorney, Agent, or Firm*—Birch, Stewart, Kolasch & Birch, LLP

(57) ABSTRACT

Provided is an apparatus for controlling an operation of a compressor which can always apply a constant voltage to the compressor without noise and a method therefor. The apparatus for controlling the operation of the compressor includes: a triac electrically connected to the compressor; and a controller for controlling a turn-on duration of the triac on the basis of a voltage value of an alternating current power applied to the compressor and a predetermined reference voltage value.

4 Claims, 2 Drawing Sheets

APPARATUS FOR CONTROLLING OPERATION OF COMPRESSOR AND METHOD THEREFORE

BACKGROUND OF THE INVENTION

1. Field of the Invention

The present invention relates to a compressor, and particularly, to an apparatus for controlling an operation of a reciprocating compressor and a method therefor.

2. Description of the Prior Art

In general, a reciprocating compressor linearly reciprocates an inner piston in a cylinder to inhale, compress and discharge refrigerant gas. A method for operating the piston may be divided into a recipro method and a linear method.

In the recipro method, a motor being rotated is connected to a crank shaft and the crank shaft is connected to the piston, thereby converting rotating power of the motor into a linear reciprocating motion. In the linear method, the piston is connected to an actuator of the motor which linearly moves, thereby reciprocating the piston based on the linear motion of the motor.

The reciprocating compressor to which the linear method is applied has a higher compressing efficiency than a typical compressor in the manner of the compressing efficiency, because there is not a crank shaft that converts the rotating motion into the linear motion, which results in a low friction loss.

When the reciprocating compressor is used in a refrigerator or an air conditioner, a winding wire of the motor in the reciprocating compressor is selected according to a variation value of a power supply voltage inputted in the reciprocating compressor, and thus a stroke of the compressor is controlled by applying a power to the selected winding wire. Hereinafter, the reciprocating compressor according to the related art will be explained with reference to FIG. 1.

FIG. 1 is a block diagram illustrating a construction of an apparatus for controlling an operation of the reciprocating compressor according to the Prior art.

Referring to FIG. 1, the apparatus for controlling the operation of the reciprocating compressor includes: a voltage detector 1 for detecting a voltage of an alternating current power applied to a motor (not shown) of a compressor 4; a controller 2 for comparing a voltage value detected by the voltage detector 1 with a predetermined reference voltage value, and generating a switching control signal based on the compared result; a switching portion (R1 and R2) 3 for selecting one of a high mode (L1), a normal mode (L2) and a low mode (L3) of the motor according to the switching control signal of the controller 2; a PTC (Positive Temperature Coefficient) thermistor 5 electrically connected to the motor, for cutting off over current generated at an initial operation of the reciprocating compressor, thereby protecting the reciprocating compressor 4 from being damaged; a reactor 6 connected to the PTC thermistor 5 in series; and a capacitor 7 electrically connected to the PTC thermistor 5 and the reactor 6 in parallel. The capacitor 7 countervails an inductance of a coil wound around the motor. That is, because the inductance of the coil is countervailed by the capacitor 7, a sufficient stroke can be generated even by a lower input voltage. Here, the stroke refers to a moved distance while the piston (not shown) of the reciprocating compressor 4 reciprocates.

Hereinafter, it will be explained how the apparatus for controlling the operation of the reciprocating compressor is operated.

First, the voltage detector 1 detects a voltage of an alternating current power applied to the motor of the compressor 4, and outputs the detected voltage value to the controller 2.

The controller 2 generates a switching control signal for controlling the switching portion 3 on the basis of the voltage value detected by the voltage detector 1 and a predetermined reference voltage value. That is, the controller 2 controls relays (R1 and R2) of the switching portion 3, according to a variation value of the voltage of the alternating current power applied to the motor of the compressor 4, thereby varying a voltage mode (operation mode) of the motor. For instance, if the voltage of the alternating current power provided to the reciprocating compressor 4 is identical to the predetermined reference voltage (e.g., 220 volt), the controller 2 outputs a switching control signal for converting the voltage mode of the motor installed in the reciprocating compressor 4 into the normal mode (L2). If the voltage of the alternating current power provided to the reciprocating compressor 4 exceeds the predetermined reference voltage (e.g., 240 volt), the controller 2 outputs a switching control signal for converting the voltage mode of the motor installed in the reciprocating compressor 4 into a high mode (L1). Moreover, if the voltage of the alternating current power provided to the reciprocating compressor 4 is less than the predetermined reference voltage (e.g., 200 volt), the controller 2 outputs a switching control signal for converting the voltage mode of the motor installed in the reciprocating compressor 4 into a low mode (L3). Here, the voltage mode is an operation mode to protect the motor from over voltage and operate the motor stably. That is, the voltage mode is for selecting one of motor stator coils which are divided into a first coil (L1: high mode), a second coil (L2: normal mode) and a third coil (L3: low mode), according to a varied input voltage.

Thereafter, the switching portion 3 selects one mode among the high mode, the normal mode and the low mode of the motor according to the switching control signal of the controller 2.

In order to prevent the reciprocating compressor 4 from being damaged due to over current when a power is provided to the motor of the compressor 4 at an initial state, on the other hand, the PTC thermistor 5 cuts off the over current applied to the motor of the compressor 4 at the initial operation of the compressor 4, thereby protecting the compressor 4 from overload. Here, the over current refers to current exceeding a reference current value which the motor of the compressor 4 allows. Furthermore, if a resistance value of the PTC thermistor itself is increased by the current applied to the motor of the compressor 4, the PTC thermistor 5 is turned off. At this time, the current is applied to the motor only through the capacitor 7.

However, the alternating current power applied to the compressor based on the related art may be increased or decreased at any time, and when the alternating current power is increased, the stroke of the compressor is also increased relative to the voltage of the alternating current power. At this time, if the stroke keeps increased by the variation of the alternating current power, the compressor can be damaged.

Also, the voltage of the alternating current power applied to the apparatus for controlling the operation of the compressor based on the related art is varied, the stroke of the compressor is operated irregularly due to the varied voltage, and in case that the alternating current power is varied, whenever the switching portion 3 which varies the capacity of the compressor is operated, noise can be occurred from the switching portion 3.

Meanwhile, a reciprocating compressor according to an another prior art is disclosed in U.S. Pat. No. 6,644,943 issued on 11 Nov. 2003.

SUMMARY OF THE INVENTION

Therefore, an object of the present invention is to provide an apparatus for controlling an operation of a compressor and a method therefor, in which when an alternating current power applied to the compressor is varied, a turn-on duration of a triac is controlled according to a variation value of the alternating current power, thereby applying a constant voltage to the compressor at any time.

Another object of the present invention is to provide an apparatus for controlling an operation of a compressor and a method therefor, in which a constant voltage can be applied to the compressor without noise when a voltage of an alternating current power applied to the apparatus for controlling the operation of the compressor is varied.

To achieve these and other advantages and in accordance with the purpose of the present invention, as embodied and broadly described herein, there is provided an apparatus for controlling an operation of a compressor, including: a triac electrically connected to the compressor; and a controller for controlling a turn-on duration of the triac based on a voltage value of an alternating current power applied to the compressor and a predetermined reference voltage value.

According to another embodiment for the purpose of the present invention, there is provided an apparatus for controlling an operation of a compressor, including: a voltage detector for detecting a voltage of an alternating current power applied to the compressor; a triac electrically connected to the compressor; and a controller for generating a switching control signal to control a turn-on duration of the triac depending on the voltage detected by the voltage detector and a predetermined reference voltage value, and outputting the generated switching control signal to the triac.

According to still another embodiment for the purpose of the present invention, there is provided an apparatus for controlling an operation of a compressor, including: a triac electrically connected to a motor of the compressor, and applying a constant voltage to the compressor by controlling its turn-on duration on the basis of a switching control signal; a voltage detector for detecting a voltage of an alternating current power applied to the triac; a controller for generating a switching control signal to control the turn-on duration of the triac depending on the voltage value detected by the voltage detector and a predetermined reference voltage value, and outputting the generated switching control signal to the triac; a PTC (Positive Temperature Coefficient) thermistor electrically connected to the motor of the compressor, for preventing the compressor from being damaged by cutting off over current generated at an initial operation of the compressor; a reactor connected to the PTC thermistor in series; and a capacitor electrically connected to the PTC thermistor and the reactor in parallel.

To achieve these and other advantages and in accordance with the purpose of the present invention, there is also provided a method for controlling an operation of a compressor, including the steps of: detecting a voltage of an alternating current power applied to the compressor; and controlling a turn-on duration of a triac electrically connected to the compressor on the basis of the detected voltage value and a predetermined reference voltage value.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, it will be described about an apparatus and a method for controlling an operation of a compressor that can always apply a constant voltage to the compressor without noise, by controlling a turn-on duration of a triac electrically connected to the compressor on the basis of a voltage value of an alternating current power applied to the compressor and a predetermined reference voltage value in detail with reference to FIGS. 2 and 3. The apparatus for controlling an operation of the compressor in accordance with the present invention can be applied to various compressors as well as a reciprocating compressor to which a recipro method or a linear method is applied.

Figure 1:
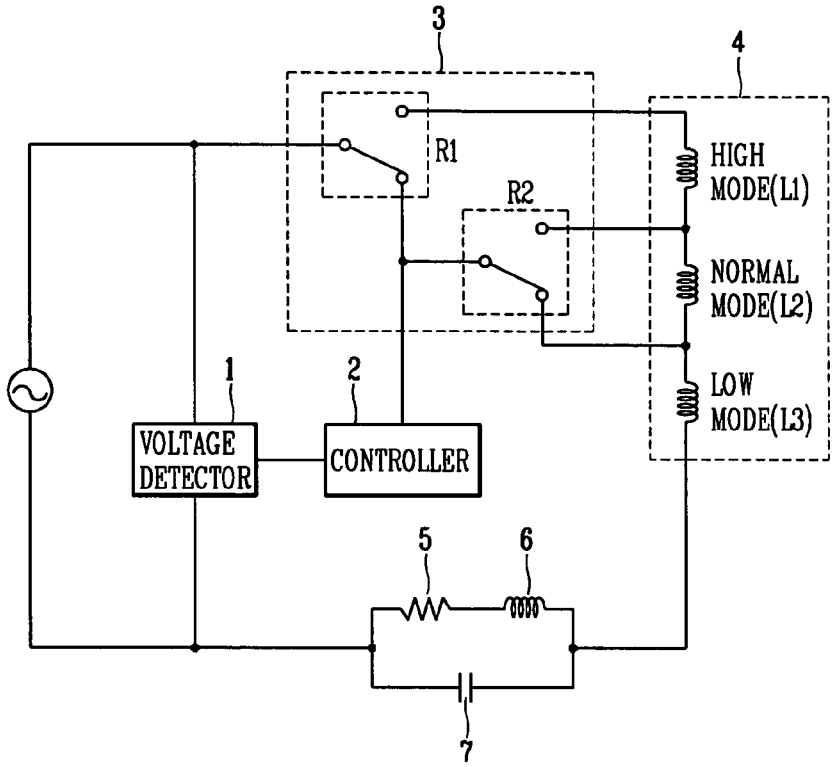
FIG. 1 PRIOR ART
FIG. 1 is a block diagram illustrating a construction of an apparatus for controlling an operation of a reciprocating compressor based on the prior art.
Figure 2:
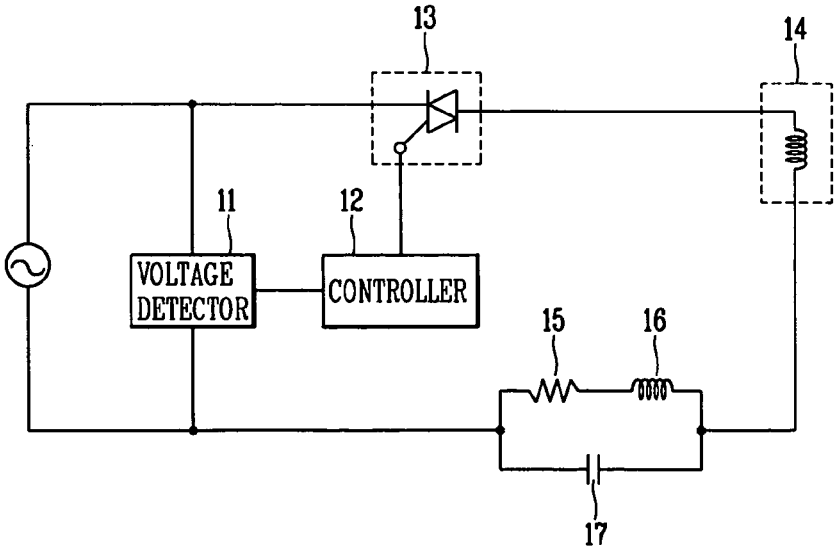
FIG. 2 is a block diagram illustrating a construction of an apparatus for controlling an operation of a compressor in accordance with a preferred embodiment of the present invention.

FIG. 2 is a block diagram illustrating a construction with respect to an apparatus for controlling an operation of a compressor in accordance with an embodiment of the present invention.

Referring to FIG. 2, the apparatus for controlling the operation of the compressor in accordance with the present invention comprises: a triac (Tr) 13 which is electrically connected to a motor of a compressor 14, and applies a constant voltage to the compressor 14 by controlling its turn-on duration depending on a switching control signal; a voltage detector 11 for detecting a voltage of an alternating current power applied to the triac 13; a controller 12 which generates a switching control signal for controlling the turn-on duration of the triac (Tr) 13 based on the voltage value detected by the voltage detector 11 and a predetermined reference voltage value, and outputs the generated switching control signal to the triac (Tr) 13; a PTC (Positive Temperature Coefficient) thermistor 15 which is electrically connected to a motor of the compressor 14, and prevents the compressor from being damaged by cutting off over current generated at the initial operation of the compressor 14; a reactor 16 connected to the PTC thermistor 15 in series; and a capacitor 17 electrically connected to the PTC thermistor 15 and the reactor 16 in parallel. Here, motor stator coils of the compressor 14 are not divided into a first coil (L1: high mode), a second coil (L2: normal mode) and a third coil (L3: low mode), like in the related art, but rather are constructed with one coil. That is, because a constant voltage is applied to the motor of the compressor at any time, there is not a need to construct the motor stator coils with a plurality of coils.

Hereinafter, it will be described about the operation of the apparatus for controlling an operation of the compressor in accordance with the present invention. Here, operations with respect to the PTC thermistor 15, the reactor 16 and capacitor 17 are same to those of the related art. Therefore, a detailed explanation of those operations will not be attached here.

First, the voltage detector 11 detects a voltage of an alternating current power applied to the triac 13 electrically connected to the compressor 14, and outputs the detected voltage value to the controller 12. Here, the controller 12 may be made up of a microcomputer.

The controller 12 compares the voltage value detected by the voltage detector 11 with a predetermined reference voltage value. The controller 12 then generates a switching control signal to control a turn-on duration of the triac (Tr) 13 based on the compared result, and thus outputs the generated switching control signal to the triac 13. For instance, assuming that the predetermined reference voltage is 220 volt and a voltage applied to the triac 13 is 240 volt, the controller 12 generates a switching control signal for shortening the turn-on duration of the triac 13 in order to maintain the voltage applied to the compressor 14 as 220 volt at any time, and thus outputs the switching control signal to the triac 13. On the other hand, assuming that the predetermined reference voltage is 220 volt and the voltage applied to the triac 13 is 200 volt, the controller 12 generates a switching control signal for lengthening the turn-on duration of the triac 13 in order to maintain the voltage applied to the compressor 14 as 220 volt, and thus outputs the switching control signal to the triac 13.

Thereafter, the triac 13 varies the alternating current power to a constant voltage (i.e., the predetermined reference voltage) by controlling the turn-on duration according to the switching control signal outputted from the controller 12. The triac 13 thus applies the constant voltage to the compressor 14. During this, the compressor 14 is stably operated depending on the constant voltage applied through the triac 13.

Therefore, in the apparatus for controlling the operation of the compressor in accordance with the present invention, if the alternating current power is varied, the variation value of the alternating current power is detected, and the turn-on duration of the triac 13 is controlled according to the variation value, thereby applying a constant voltage to the compressor at any time.

Figure 3:
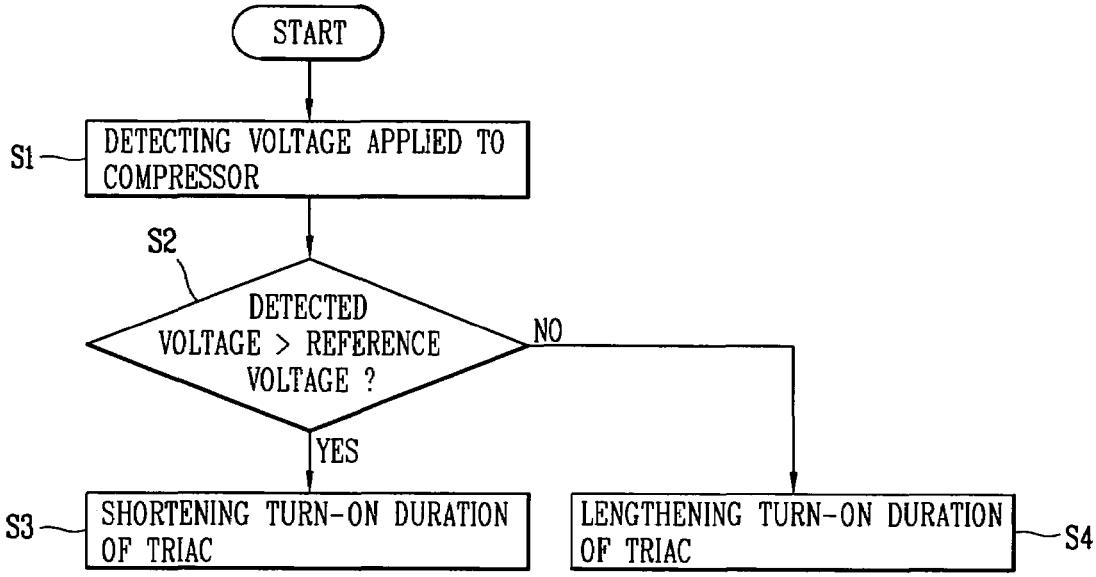
FIG. 3 is a flow chart illustrating an operation with respect to a method for controlling an operation of a compressor in accordance with the present invention.

FIG. 3 is a flow chart illustrating an operation with respect to a method for controlling an operation of a reciprocating compressor in accordance with the present invention.

First, when an alternating current power is applied to the apparatus for controlling the operation of the compressor 14 by a user, the voltage detector 11 detects a voltage of the alternating current power, and outputs the detected voltage value to the controller 12 (S1).

The controller 12 compares the voltage value detected by the voltage detector 11 with a predetermine reference voltage value (S2).

Thereafter, if the voltage value detected by the voltage detector 11 is greater than the predetermined reference voltage value, the controller 12 generates a switching control signal for shortening the turn-on duration of the triac 13 in order to maintain a voltage applied to the triac as the predetermined reference voltage, and then outputs the switching control signal to the triac 13 (S3). Here, if the turn-on duration of the triac 13 is shortened, a voltage applied to the compressor 14 is decreased according to the characteristic of the triac 13.

On the other side, if the voltage value detected by the voltage detector 11 is smaller than the predetermined reference voltage value, the controller 12 generates a switching control signal for lengthening the turn-on duration of the triac 13 in order to maintain a voltage applied to the triac as the predetermined reference voltage, and then outputs the switching control signal to the triac 13 (S4). Here, if the turn-on duration of the triac 13 is lengthened, the voltage applied to the compressor 14 is increased according to the characteristic of the triac 13.

Then, the triac 13 varies the alternating current power to a constant voltage (i.e., the predetermined reference voltage) by controlling the turn-on duration according to the switching control signal outputted from the controller 12, thereby applying the constant voltage to the compressor 14. During this, the compressor 14 is stably operated by the constant voltage applied through the triac 13.

Thus, in the apparatus for controlling the operation of the compressor in accordance with the present invention, when the voltage applied to the compressor is varied, the constant voltage is always applied to the compressor by controlling the turn-on duration of the triac. According to this, the reliability of the compressor can be improved.

As aforementioned, in the apparatus for controlling the operation of the compressor in accordance with the present invention and the method therefor, when the voltage of the alternating current power applied o the compressor is varied, the turn-on duration of the triac is controlled, thereby achieving an effect capable of applying the constant voltage to the compressor at any time.

Furthermore, in the apparatus for controlling the operation of the compressor in accordance with the present invention and the method therefor, because a relay is not used, there can be further effect capable of applying the constant voltage to the compressor without noise.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for controlling an operation of a compressor, comprising:

a voltage detector for detecting a voltage of an alternating current power applied to the compressor;

a triac electrically connected to the compressor; and a controller for generating a switching control signal to control a turn-on duration of the triac depending on the voltage detected by the voltage detector and a predetermined reference voltage value, and outputting the generated switching control signal to the triac, wherein the controller generates a first switching control signal for shortening the turn-on duration of the triac and outputs the generated first switching control signal to the triac, when the detected voltage value is greater than the predetermined reference voltage value; and the controller generates a second switching control signal for lengthening the turn-on duration of the triac and outputs the generated second switching control signal to the triac, when the detected voltage value is smaller than the predetermined reference voltage value.

2. A method for controlling an operation of a compressor, comprising the steps of:

detecting a voltage of an alternating current power applied to the compressor;

shortening a turn-on duration of a triac electrically connected the compressor when the detected voltage value is greater than a predetermined reference voltage value; and lengthening the turn-on duration of the triac when the detected voltage value is smaller than the predetermined reference voltage value.

3. The method of claim 2, wherein in the step of controlling the turn-on duration of the triac, the turn-on duration of the triac is controlled for applying a constant voltage to the compressor when the alternating current power is varied.

4. An apparatus for controlling an operation of a compressor, comprising:

a triac electrically connected to a motor of the compressor, and applying a constant voltage to the compressor by controlling its turn-on duration on the basis of a switching control signal;

a voltage detector for detecting a voltage of an alternating current power applied to the triac;

a controller for generating a switching control signal to control a turn-on duration of the triac depending on the voltage value detected by the voltage detector and a predetermined reference voltage value, and outputting the generated switching control signal to the triac;

a PTC (positive Temperature Coefficient) thermistor electrically connected to the motor of the compressor, and preventing the compressor from being damaged by cutting off over current generated at an initial operation of the compressor;

a reactor connected to the PTC thermistor in series; and a capacitor electrically connected to the PTC thermistor and the reactor in parallel, wherein the controller generates a first switching control signal for shortening the turn-on duration of the triac and outputs the generated first switching control signal to the triac, when that the detected voltage value is greater than the predetermined reference voltage value; and the controller generates a second switching control signal for lengthening the turn-on duration of the triac and outputs the generated second switching control signal to the triac, when the detected voltage value is smaller than the predetermined reference voltage value.

* * * * *